US008800780B2

(12) United States Patent
Burkhard

(10) Patent No.: US 8,800,780 B2
(45) Date of Patent: Aug. 12, 2014

(54) MOTORS WITH MAGNETIC COUPLING FOR TRANSFER OF SHAKER MOTION

(75) Inventor: Alan Wayne Burkhard, Fort Thomas, KY (US)

(73) Assignee: M-I L.L.C., Houston, TX (US)

( * ) Notice: Subject to any disclaimer, the term of this patent is extended or adjusted under 35 U.S.C. 154(b) by 675 days.

(21) Appl. No.: 11/961,759

(22) Filed: Dec. 20, 2007

(65) Prior Publication Data

US 2008/0149538 A1 Jun. 26, 2008

Related U.S. Application Data

(60) Provisional application No. 60/871,222, filed on Dec. 21, 2006.

(51) Int. Cl.
*B07B 1/42* (2006.01)
*B03C 1/08* (2006.01)
*B03C 1/28* (2006.01)

(52) U.S. Cl.
CPC . *B03C 1/288* (2013.01); *B03C 1/08* (2013.01); *B03C 2201/18* (2013.01)
USPC ..... 209/368; 209/365.1

(58) Field of Classification Search
USPC ..... 209/368, 365.1, 365.2, 365.3, 365.4
See application file for complete search history.

(56) References Cited

U.S. PATENT DOCUMENTS

| | | | | |
|---|---|---|---|---|
| 1,291,170 | A * | 1/1919 | Ruprecht | 209/368 |
| 1,620,213 | A * | 3/1927 | Keenan | 209/368 |
| 2,144,173 | A * | 1/1939 | Konold et al. | 209/368 |
| 2,746,598 | A * | 5/1956 | Sherwen | 198/769 |
| 4,011,477 | A * | 3/1977 | Scholin | 310/80 |
| 6,513,664 | B1 * | 2/2003 | Logan et al. | 209/367 |
| 6,679,385 | B2 | 1/2004 | Suter et al. | |
| 8,141,714 | B2 * | 3/2012 | Burkhard | 209/365.1 |
| 8,596,463 | B2 * | 12/2013 | Burkhard | 209/365.1 |
| 2002/0153288 | A1 * | 10/2002 | Suter et al. | 209/365.4 |
| 2005/0242003 | A1 * | 11/2005 | Scott et al. | 209/363 |

FOREIGN PATENT DOCUMENTS

| | | |
|---|---|---|
| JP | 8-141507 | 6/1996 |
| JP | 8323289 | 12/1996 |

OTHER PUBLICATIONS

PCT International Search Report issued in PCT Application No. PCT/US2007/088572 dated Jun. 2, 2008 (3 pages).
PCT Written Opinion issued in PCT Application No. PCT/US2007/088572 dated Jun. 2, 2008 (4 pages).

(Continued)

*Primary Examiner* — Ernesto Suarez
(74) *Attorney, Agent, or Firm* — Osha Liang LLP

(57) ABSTRACT

A vibratory separator including a basket including a first magnetic component disposed on the basket and a motor including a motor shaft and a second magnetic component coupled to the motor shaft. Furthermore, the first magnetic component and the second magnetic component are arranged to magnetically interact, and the interaction between the first magnetic components and the second magnetic component imparts a vibratory motion to the basket. Additionally, a method of operating a vibratory separator including injecting drilling material into a vibratory separator. The vibratory separator including a basket including a first magnetic component disposed on the basket and a motor including a motor shaft and a second magnetic component coupled to the motor shaft, wherein the first magnetic component and the second magnetic component are arranged to magnetically interact, and wherein the interaction between the first magnetic components and the second magnetic component imparts a vibratory motion to the basket. Furthermore, imparting a vibratory motion to the basket by interacting the first magnetic component and the second magnetic component.

18 Claims, 8 Drawing Sheets

(56) References Cited

OTHER PUBLICATIONS

English Patent Abstract of JP8-141507 from esp@cenet, published Jun. 4, 1996 (1 page).

English Patent Abstract of JP8323289 from esp@cetnet, published Dec. 10, 1996 (1 page).

Examination Report issued in corresponding British Patent Application No. GB0911800.1; Dated Nov. 9, 2010 (2 pages).

* cited by examiner

MOTORS WITH MAGNETIC COUPLING FOR TRANSFER OF SHAKER MOTION

CROSS-REFERENCE TO RELATED APPLICATIONS

This application, pursuant to 35 U.S.C. §119(e), claims priority to U.S. Provisional Application Ser. No. 60/871,222, filed Dec. 21, 2006. That application is incorporated by reference in its entirety.

BACKGROUND

1. Field of the Disclosure

Generally, embodiments disclosed herein relate to apparatuses and methods for separating solids from liquids. Specifically, embodiments disclosed herein relate to apparatuses and methods for imparting a vibratory motion through magnetic forces to components of a vibratory separator.

2. Background

Oilfield drilling fluid, often called "mud," serves multiple purposes in the industry. Among its many functions, the drilling mud acts as a lubricant to cool rotary drill bits and facilitate faster cutting rates. Typically, the mud is mixed at the surface and pumped downhole at high pressure to the drill bit through a bore of the drillstring. Once the mud reaches the drill bit, it exits through various nozzles and ports where it lubricates and cools the drill bit. After exiting through the nozzles, the "spent" fluid returns to the surface through an annulus formed between the drillstring and the drilled wellbore.

Furthermore, drilling mud provides a column of hydrostatic pressure, or head, to prevent "blow out" of the well being drilled. This hydrostatic pressure offsets formation pressures thereby preventing fluids from blowing out if pressurized deposits in the formation are breeched. Two factors contributing to the hydrostatic pressure of the drilling mud column are the height (or depth) of the column (i.e., the vertical distance from the surface to the bottom of the wellbore) itself and the density (or its inverse, specific gravity) of the fluid used. Depending on the type and construction of the formation to be drilled, various weighting and lubrication agents are mixed into the drilling mud to obtain the right mixture. Typically, drilling mud weight is reported in "pounds," short for pounds per gallon. Generally, increasing the amount of weighting agent solute dissolved in the mud base will create a heavier drilling mud. Drilling mud that is too light may not protect the formation from blow outs, and drilling mud that is too heavy may over invade the formation. Therefore, much time and consideration is spent to ensure the mud mixture is optimal. Because the mud evaluation and mixture process is time consuming and expensive, drillers and service companies prefer to reclaim the returned drilling mud and recycle it for continued use.

Another significant purpose of the drilling mud is to carry the cuttings away from the drill bit at the bottom of the borehole to the surface. As a drill bit pulverizes or scrapes the rock formation at the bottom of the borehole, small pieces of solid material are left behind. The drilling fluid exiting the nozzles at the bit acts to stir-up and carry the solid particles of rock and formation to the surface within the annulus between the drillstring and the borehole. Therefore, the fluid exiting the borehole from the annulus is a slurry of formation cuttings in drilling mud. Before the mud can be recycled and repumped down through nozzles of the drill bit, the cutting particulates must be removed.

Apparatus in use today to remove cuttings and other solid particulates from drilling fluid are commonly referred to in the industry as shale shakers or vibratory separators. A vibratory separator is a vibrating sieve-like table upon which returning solids laden drilling fluid is deposited and through which clean drilling fluid emerges. Typically, the vibratory separator is an angled table with a generally perforated filter screen bottom. Returning drilling fluid is deposited at the feed end of the vibratory separator. As the drilling fluid travels down length of the vibrating table, the fluid falls through the perforations to a reservoir below leaving the solid particulate material behind. The vibrating action of the vibratory separator table conveys solid particles left behind until they fall off the discharge end of the separator table. The above described apparatus is illustrative of one type of vibratory separator known to those of ordinary skill in the art. In alternate vibratory separators, the top edge of the separator may be relatively closer to the ground than the lower end. In such vibratory separators, the angle of inclination may require the movement of particulates in a generally upward direction. In still other vibratory separators, the table may not be angled, thus the vibrating action of the separator alone may enable particle/fluid separation. Regardless, table inclination and/or design variations of existing vibratory separators should not be considered a limitation of the present disclosure.

Preferably, the amount of vibration and the angle of inclination of the vibratory separator table are adjustable to accommodate various drilling fluid flow rates and particulate percentages in the drilling fluid. After the fluid passes through the perforated bottom of the vibratory separator, it can either return to service in the borehole immediately, be stored for measurement and evaluation, or pass through an additional piece of equipment (e.g., a drying shaker, centrifuge, or a smaller sized shale shaker) to further remove smaller cuttings.

A typical vibratory separator consists of an elongated, box-like, rigid bed, and a screen attached to, and extending across, the bed. The bed is vibrated as the material to be separated is introduced to the screen. The vibrations, often in conjunction with gravity, move the relatively large size material along the screen and off the end of the bed. Liquid and/or relatively small sized material passes through the screen into a pan. The bed is typically vibrated by pneumatic, hydraulic, or rotary vibrators, in a conventional manner.

A plurality of motions has been commonly used for the screening of materials, including linear, round, and elliptical motion. Currently, when a drilling operator chooses a separatory profile, therein selecting a type of motion that actuators of the vibratory separator will provide to the screen assemblies, they typically choose between a profile that either processes drilling material quickly or thoroughly. It is well known in the art that providing linear motion increases the G-forces acting on the drilling material, thereby increasing the speed of conveyance and enabling the vibratory separator to process heavier solids loads. By increasing the speed of conveyance, linear motion vibratory shakers provide increased shaker fluid capacity and increased processing volume. However, in certain separatory operations, the weight of solids may still restrict the speed that linear motion separation provides. Additionally, while increased G-forces enable faster conveyance, as the speed of conveyance increases, there is a potential that the produced drill cuttings may still be saturated in drilling fluid.

Alternatively, a drilling operator may select a vibratory profile that imparts lower force vibrations onto the drilling material, thereby resulting in drier cuttings and increased drilling fluid recovery. However, such lower force vibrations generally slow drilling material processing, thereby increasing the time and cost associated with processing drilling material.

Round motion may be generated by a simple eccentric weight located roughly at the center of gravity of a resiliently mounted screening device with the rotational axis extending perpendicular to the vertical symmetrical plane of the separator. Such motion is considered to be excellent for particle separation and excellent for screen life. It requires a very simple mechanism, a single rotationally driven eccentric weight. However, round motion acts as a very poor conveyor of material and becomes disadvantageous in continuous feed systems where the oversized material is to be continuously removed from the screen surface. Machines are also known with two parallel axes of eccentric rotation extending perpendicular to the symmetrical plane.

Another common motion is achieved through the counter rotation of adjacent eccentric vibrators also affixed to a resiliently mounted screening structure. Through the orientation of the eccentric vibrators at an angle to the screening plane, linear vibration may be achieved at an angle to the screen plane. Such inclined linear motion has been found to be excellent for purposes of conveying material across the screen surface. However, it has been found to be relatively poor for purposes of separation and is very hard on the screens.

Another motion commonly known as multi-direction elliptical motion is induced where a single rotary eccentric vibrator is located at a distance from the center of gravity of the screening device. This generates elliptical motions in the screening device. However, the elliptical motion of any element of the screen has a long axis passing through the axis of the rotary eccentric vibrator. Thus, the motion varies across the screening plane in terms of direction. This motion has been found to produce efficient separation with good screen life. As only one eccentric is employed, the motion is simple to generate. However, such motion is very poor as a conveyor.

In general, the efficiency of the shaker may be influenced by the vibration pattern of the shaker, as described above. The vibratory motions described above are typically imparted to the shaker screen through rotation of at least one unbalanced weight by a rotary motor. Shaker efficiency may also be influenced by the vibration dynamics, or G-force imparted to the particles due to the shaking. Other variables that may influence efficiency include deck size and configuration, shaker processing efficiency, and shaker screen characteristics. The angle of the shaker screen, or deck angle, relative to horizontal may also affect separation efficiency. Deck angle is often controlled hydraulically, and can be automated or manually adjusted.

The vibratory motion of typical shakers is generated by one or more motors attached to the basket of the shaker. In such shakers, motors and actuation devices may be placed on or be integral to the basket. The location of the motors facilitates the transference of forces generated by the motors to the basket by allowing a motors shaft to couple to an actuator, which transfers motion to the basket. However, while placing motors and actuation devices on the frame and support members of the vibratory separator may facilitate the transference of forces to the basket, the motors also create stress points on the basket. Over time, the stress points caused by the basket mounted motors may result in structural failure of the basket. Such structural failure may require taking the shaker out of service, thereby resulting in expensive and time consuming repairs.

Furthermore, basket mounted motors complicate the replacement of critical shaker components, such as, for example, screen assemblies. In typical shakers with basket mounted motors, screens and/or screen assemblies are attached to the shaker underneath the motors, and thus the basket is heavy and screens may be difficult to reach during routine maintenance. Because of the location of the motors, routine maintenance, such as, for example, screen changes, may take substantial time. During screen changes the shaker is taken out of service, and in operations with only one screen, such routine maintenance may result in rig down time, thereby increasing net costs associated with the drilling operation.

Accordingly, there exists a need for a vibratory shaker with actuator devices for providing a vibratory motion to a screen assembly that may allow for faster screen changes, less structural failure, and a range of vibratory motions.

SUMMARY OF THE DISCLOSURE

In one aspect, embodiments disclosed herein relate to a vibratory separator including a basket including a first magnetic component disposed on the basket and a motor including a motor shaft and a second magnetic component coupled to the motor shaft. Furthermore, the first magnetic component and the second magnetic component are arranged to magnetically interact, and the interaction between the first magnetic components and the second magnetic component imparts a vibratory motion to the basket.

In another aspect, embodiments disclosed herein relate to a method of operating a vibratory separator including injecting drilling material into a vibratory separator. The vibratory separator including a basket including a first magnetic component disposed on the basket and a motor including a motor shaft and a second magnetic component coupled to the motor shaft, wherein the first magnetic component and the second magnetic component are arranged to magnetically interact, and wherein the interaction between the first magnetic components and the second magnetic component imparts a vibratory motion to the basket. Furthermore, imparting a vibratory motion to the basket by interacting the first magnetic component and the second magnetic component.

Other aspects and advantages of the disclosure will be apparent from the following description and the appended claims.

DETAILED DESCRIPTION

Generally, embodiments disclosed herein relate to apparatuses and methods for separating solids from liquids. Specifically, embodiments disclosed herein relate to apparatuses and methods for imparting a vibratory motion through magnetic forces to components of a vibratory separator.

Figure 1:
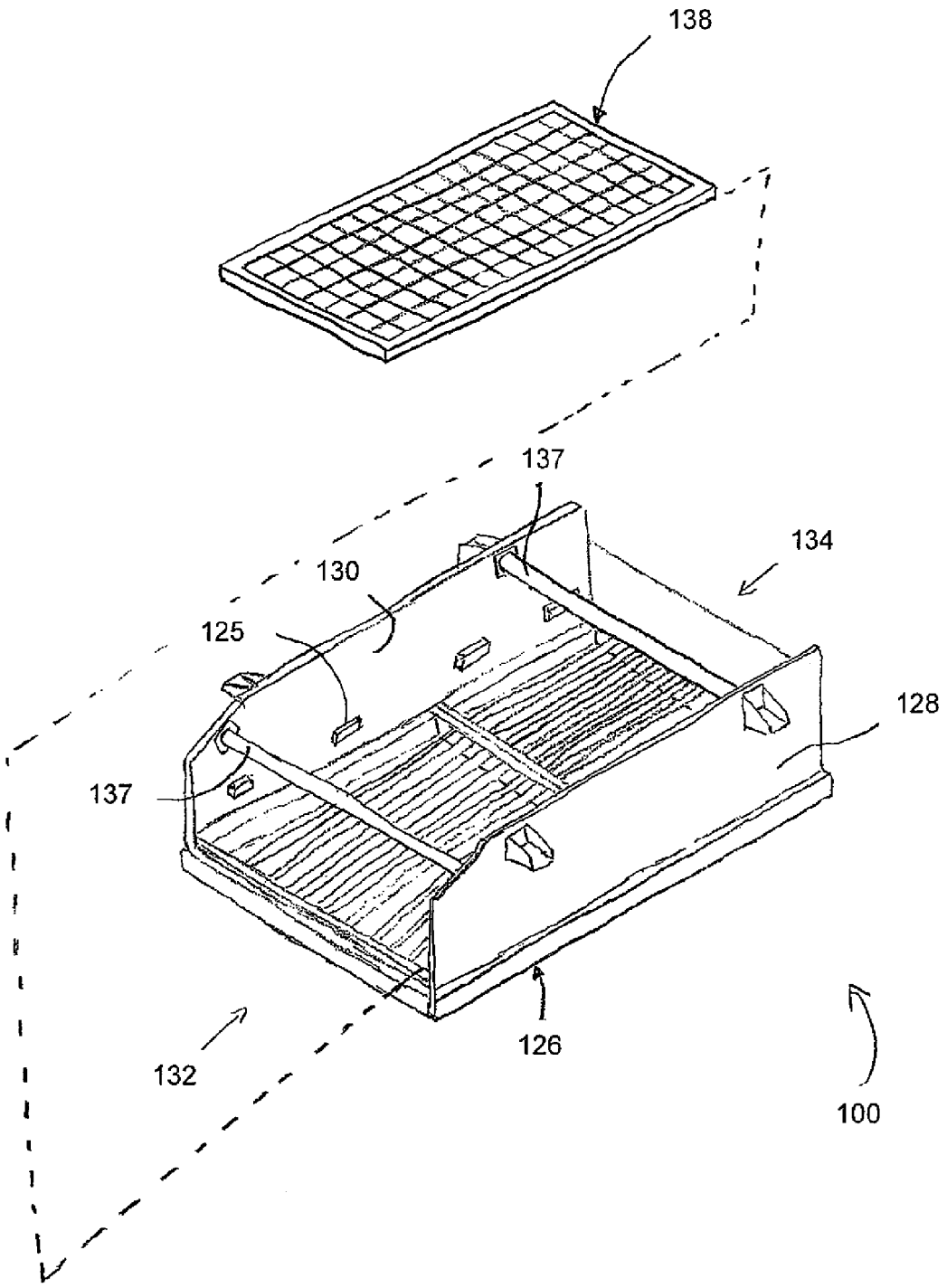
FIG. 1 is an isometric view of a vibratory separator in accordance with an embodiment of the present disclosure.
Figure 2A:
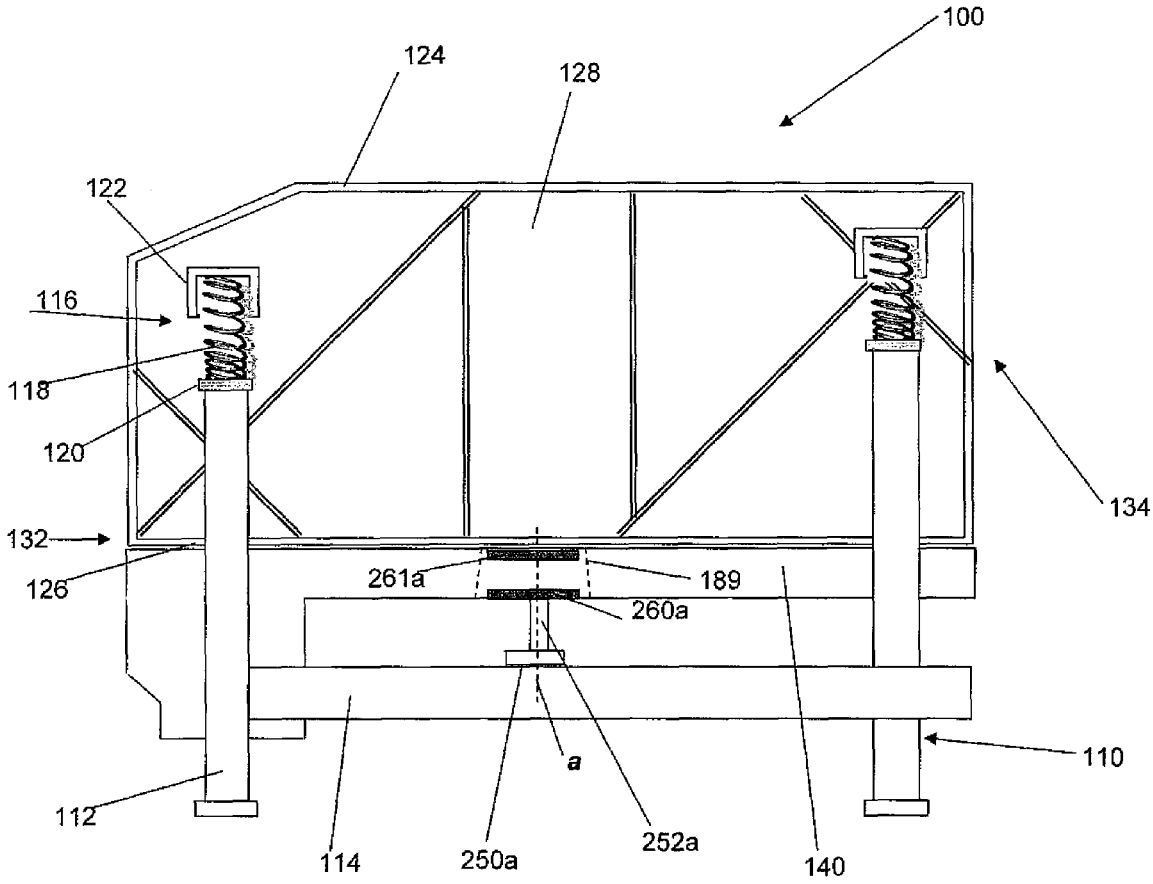
FIGS. 2A-2D are side views of a vibratory separator in accordance with an embodiment of the present disclosure.
Figure 2B:
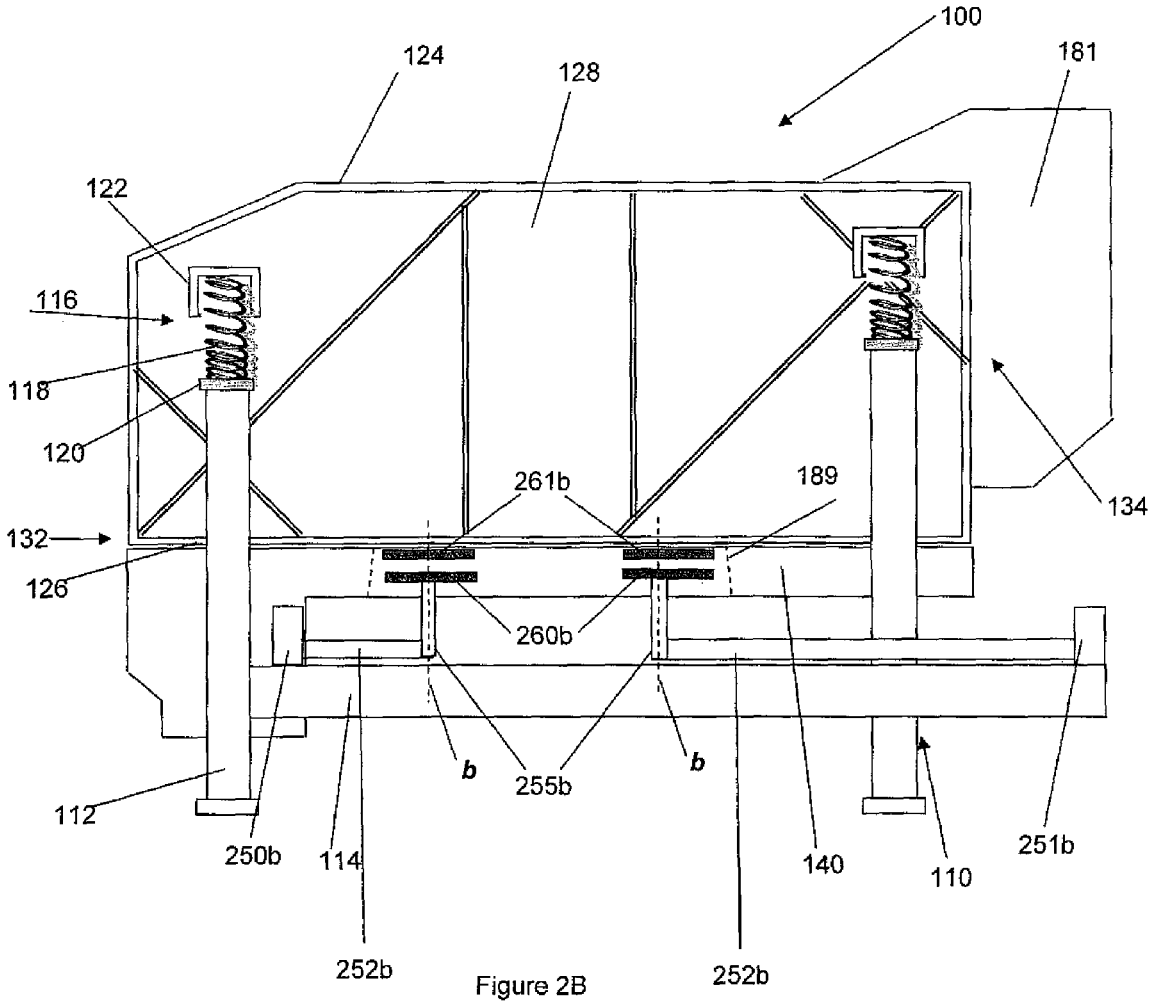
Figure 2C:
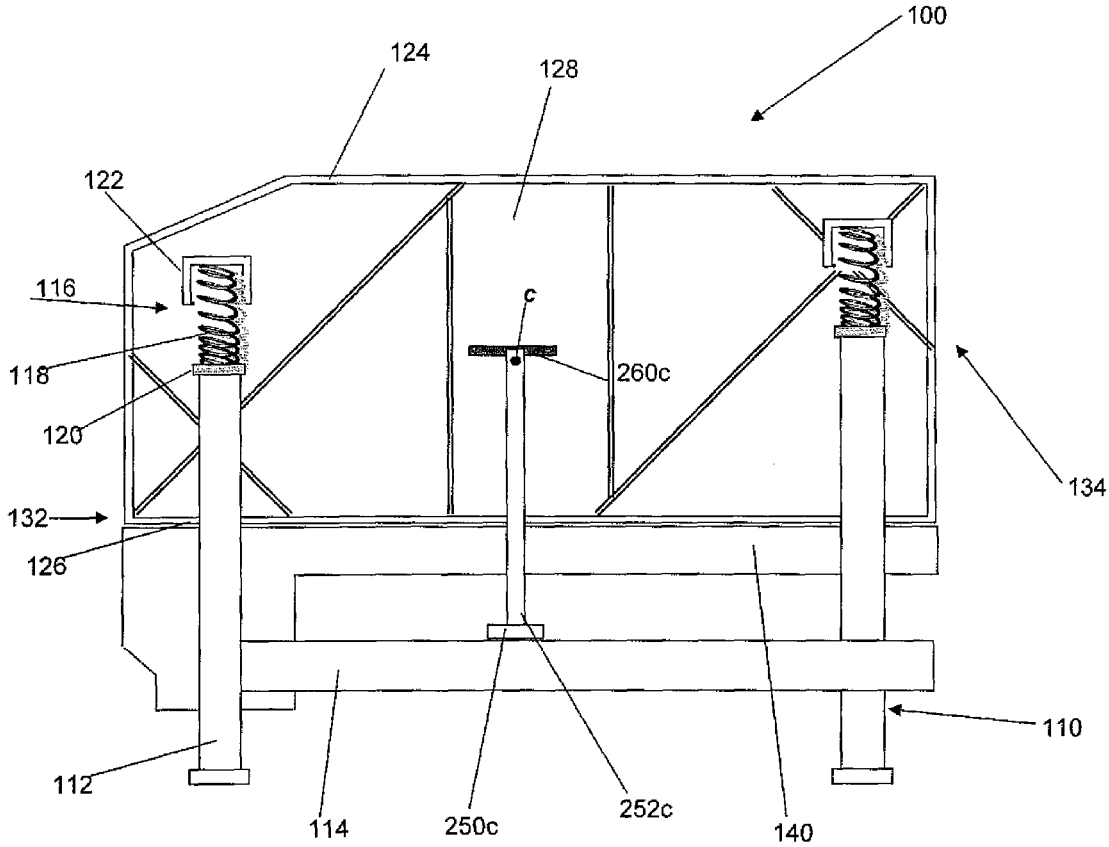
Figure 2D:
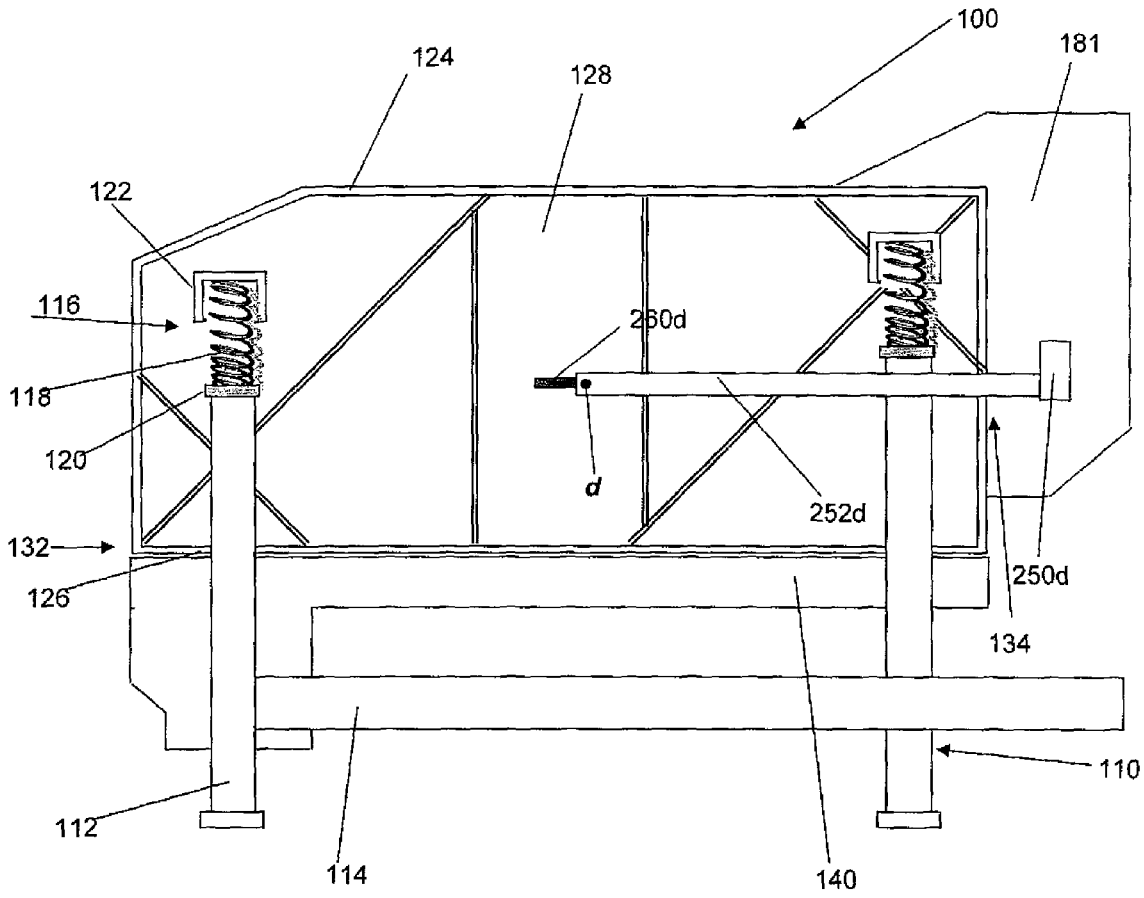

Referring initially to FIGS. 1-2D, isometric and side views of a vibrating separator 100 in accordance with embodiments of the present disclosure are shown. Vibrating separator 100 includes a base 110 having four legs 112 and support members 114. Support members 114 extend between each of the four legs or between two of the four legs as necessary for supporting vibratory separator 100. Optionally mounted on legs 112 may be resilient mounts 116. As illustrated, each mount 116 includes a spring 118, a resilient mount base 120 on each leg 112, and a socket 122 to receive each spring 118. Positioned on base 110 adjacent resilient mounts 116 is a basket 124. One of ordinary skill in the art will appreciate that any number of resilient mounts 116 may be used, and the position of resilient mounts 116 may be varied, without departing from the scope of the present disclosure.

Basket 124 includes a bed frame 126, side walls 128, 130, a discharge end 132, and an inlet end 134. Basket 124 may also include one or more cross support members 137. One or more screens 138 may be disposed within basket 124, and may be coupled to basket 124 using a screen mounting 125 located along side walls 128, 130 above bed frame 126. Screen mounting 125 may be any type of mounting known in the art to support screen 138 within a separator frame, including wedges and wedge guides, hydraulic clamps, and bolts.

Operationally, as a mixture of solids or a mixture of solids and fluids, such as drilling material for example, enters vibratory separator 100 through inlet end 134, the drilling material is moved along screens 138 by a vibratory motion. As basket 124 vibrates, residual drilling fluid and particulate matter may fall through screens 138 for collection and recycling, while larger solids are discharged from discharge end 132. A pan 140 may be located below bed frame 126 to receive material passing through screens 138.

Generally, for embodiments of the vibratory separators disclosed herein, vibratory motion may be supplied by one or more motors coupled to a first magnetic component for imparting vibratory motion to basket 124. A second magnetic component may be disposed on the basket opposite the first magnetic component. Vibratory motion may be generated by controlling or varying a magnetic force between the first magnetic component and the second magnetic component. For example, in some embodiments, as the motor shaft rotates, the first magnetic component may cyclically alternate between attractive and repulsive forces toward the second component, thereby imparting vibratory motion to the basket. The relative strengths of the magnetic fields and the cyclic period between attractive and repulsive forces may be used to control the amount of vibration imparted to the basket. Additionally, the relative placement of the magnetic components may control the direction or angle of the motion. Further, the motors may be operatively connected to a programmable logic controller ("PLC") that may supply instructions to the motors, or other components of vibratory separator 100. The instructions to the motors may include vibratory motion protocols that define a pattern of movement for moving basket 124 and/or bed frame 126.

Referring to FIG. 2A, motor 250*a* is be disposed on a support member 114. A motor shaft 252*a* is attached to motor 250*a*. Motor shaft 252*a* extends vertically toward basket 124 and is configured to rotate along a central axis a. A magnetic holder (not shown) may be attached to the top of motor shaft 252*a*. The magnetic holder may thereby secure a first magnetic component 260*a* substantially perpendicular to motor shaft 252*a*. One of ordinary skill in the art will appreciate that magnetic holder may be comprised of any material, and may include clasps for holding first magnetic component 260*a* secured in place. Further, one of ordinary skill in the art will appreciate that magnetic holder 260*a* is not necessary, and that magnetic component 260*a* may be directly mounted on motor shaft 252*a*.

A second magnetic component 261*a* is disposed opposite first magnetic component 260*a*, mounted on the bottom of basket 124. The rotation of motor shaft 252*a* causes first magnetic component 260*a* to rotate in a propeller like motion. The rotation of first magnetic component 260*a* cyclically alternates between attracting and repulsing second magnetic component 261*a*, thereby imparting vibratory motion to basket 124.

In other embodiments, one or more motors may be disposed on support member 114, similar to the embodiment shown in FIG. 2A, but may be disposed in alternate locations on or proximate vibratory separator 100. For example, as illustrated in FIG. 2B, motor 250*b* is disposed on support member 114 proximate leg 112. A second motor 251*b* is disposed on support member 114 proximate possum belly 181. A possum belly 181 (i.e., a drilling fluid inlet tank) is attached to inlet end 134 of basket 124. One of ordinary skill in the art will appreciate that basket 124 may not include possum belly 181 and still be in accordance with embodiments of the present disclosure.

One or more motor shafts 252*b* may be attached to each motor 250*b* and 251*b*. Motor shafts 252*b* extend horizontally along support member 114. A flex shaft 255*b* is attached perpendicularly to each motor shaft 252*b*, and configured to rotate along a central axis b. One of ordinary skilled in the art will appreciate that flex shaft 255*b* may be attached to motor shaft 252*b* at any angle depending on the relative location of magnetic components 261*b* mounted on basket 124.

In some embodiments, a magnetic holder (not shown) may be attached to an end of flex shaft 255*b*. The magnetic holder may thereby secure a first magnetic component 260*b* substantially perpendicular to each flex shaft 255*b*. One of ordinary skill in the art will appreciate that the magnetic holder may be comprised of any material, and may include clasps for holding first magnetic component 260*b*. Further, one of ordinary skill in the art will appreciate that the magnetic holder is not necessary, and each magnetic component 260*b* may be directly mounted on flex shaft 255*b*.

Still referring to FIG. 2B, second magnetic components 261*b* are disposed opposite each first magnetic component 260*b* and disposed on the bottom of basket 124. The rotation of flex shaft 255*b* causes first magnetic component 260*b* to rotate in a propeller like motion. Rotation of first magnetic component 260*b* cyclically alternates between attracting and repulsing second magnetic component 261*b*, thereby imparting vibratory motion to basket 124.

In other embodiments, one or more magnetic components may be disposed on one or more side walls 128 of vibratory separator 100. For example, referring specifically to FIG. 2C, a motor 250*c* is installed on support member 114 proximate the center of basket 124. A motor shaft 252*c* is attached to motor 250*c*. Motor shaft 252*c* extends vertically toward the top of basket 124 proximate one or more side walls 128. A flex shaft (not shown) may be attached perpendicular to motor shaft 252*c* and configured to rotate along a central axis c. One of ordinary skilled in the art will appreciate that the flex shaft (not shown) may be disposed at any angle, depending on the relative location of the magnetic components (not shown) mounted on basket 124.

As described above, in some embodiments, a magnetic holder (not shown) may be attached to the flex shaft (not shown). The magnetic holder may secure a first magnetic component 260*c* substantially perpendicular to the flex shaft (not shown). One of ordinary skill in the art will appreciate that the magnetic holder may be comprised of any material, and may include clasps for holding first magnetic component 260*c*. Further, one of ordinary skill in the art will appreciate that the magnetic holder is not necessary, and magnetic component 260*c* may be directly mounted on the flex shaft (not shown).

Still referring to FIG. 2C, the second magnetic component (not shown) is disposed opposite first magnetic component 260*c* and disposed on one or more side walls 128. Rotation of the flex shaft (not shown) causes first magnetic component 260*c* to rotate in a propeller like motion. The rotation of first magnetic component 260*c* cyclically alternates between attracting and repulsing second magnetic component (not shown), thereby imparting vibratory motion to the basket. Types of magnetic holders that may be used in accordance with embodiments disclosed herein are discussed in copending U.S. Provisional Application No. 60/871,379, titled Magnetic Coupling for Shaker Motion without Motors, filed Dec. 21, 2006, assigned to the assignee of the present application, and incorporated herein by reference in its entirety.

Referring back to FIG. 2D, as illustrated, one or more motors 250*d* are disposed on a possum belly 181. A motor shaft 252*d* may be attached to motor 250*d*. As illustrated, motor shaft 252*d* extends horizontally, proximate one or more sidewalls 128 of basket 124. A flex shaft (not shown) may be attached perpendicular to motor shaft 252*d* and configured to rotate along a central axis d. One of ordinary skill in the art will appreciate that the flex shaft (not shown) may be disposed at any angle with motor shaft 252*d*, depending upon where the magnetic components are mounted on basket 124. One of ordinary skill in the art will also appreciate that additional components (e.g., magnetic holder and sealing components) as described above, may be included without departing from the scope of the present disclosure.

In other embodiments, one or more motors may be installed along side rails, back rails, corners, or on other support members (not shown), such as a cross-members, intermediate side rails, and back rails, and as such, may impart horizontal motion (e.g., front-to-back motion, side-to-side motion, or any combination thereof) to basket 124. In other embodiments, the motors may be disposed on legs 112, imparting horizontal motion thereto. In still other embodiments, the motors may be vertically disposed on legs 112, or other support members, to impart vertical motion to basket 124. In yet other embodiments, one or more motors may be angularly disposed on legs 112, rails 114, or other support members. Angularly disposed motors may provide for the impartation of motion that is at an angle with respect to basket 124 (i.e., both horizontal and vertical forces may be imparted to the basket). While the above described embodiments describe a motor imparting a vibratory motion in a single direction, those of ordinary skill in the art will appreciate that motors may impart motion in multiple directions.

Figure 3A:
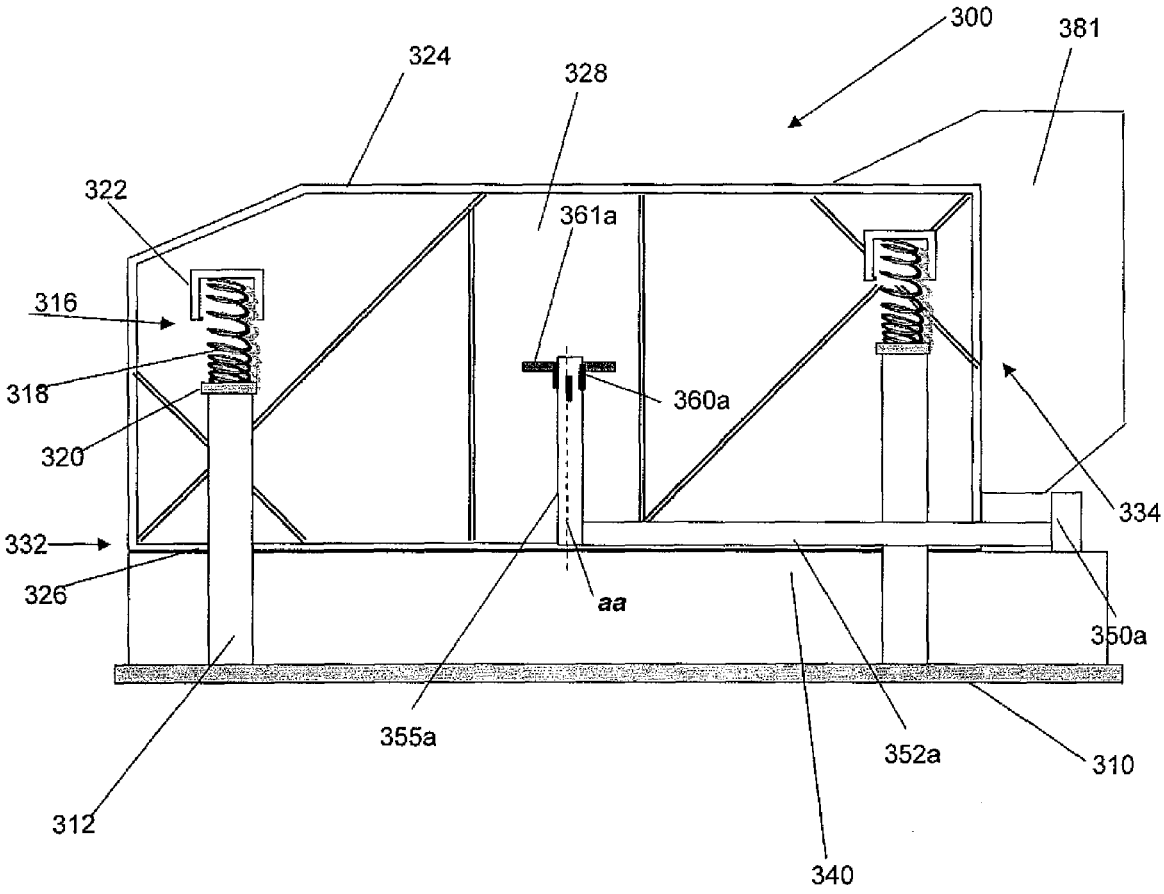
FIGS. 3A-3B are side views of a vibratory separator in accordance with embodiments of the present disclosure.
Figure 3B:
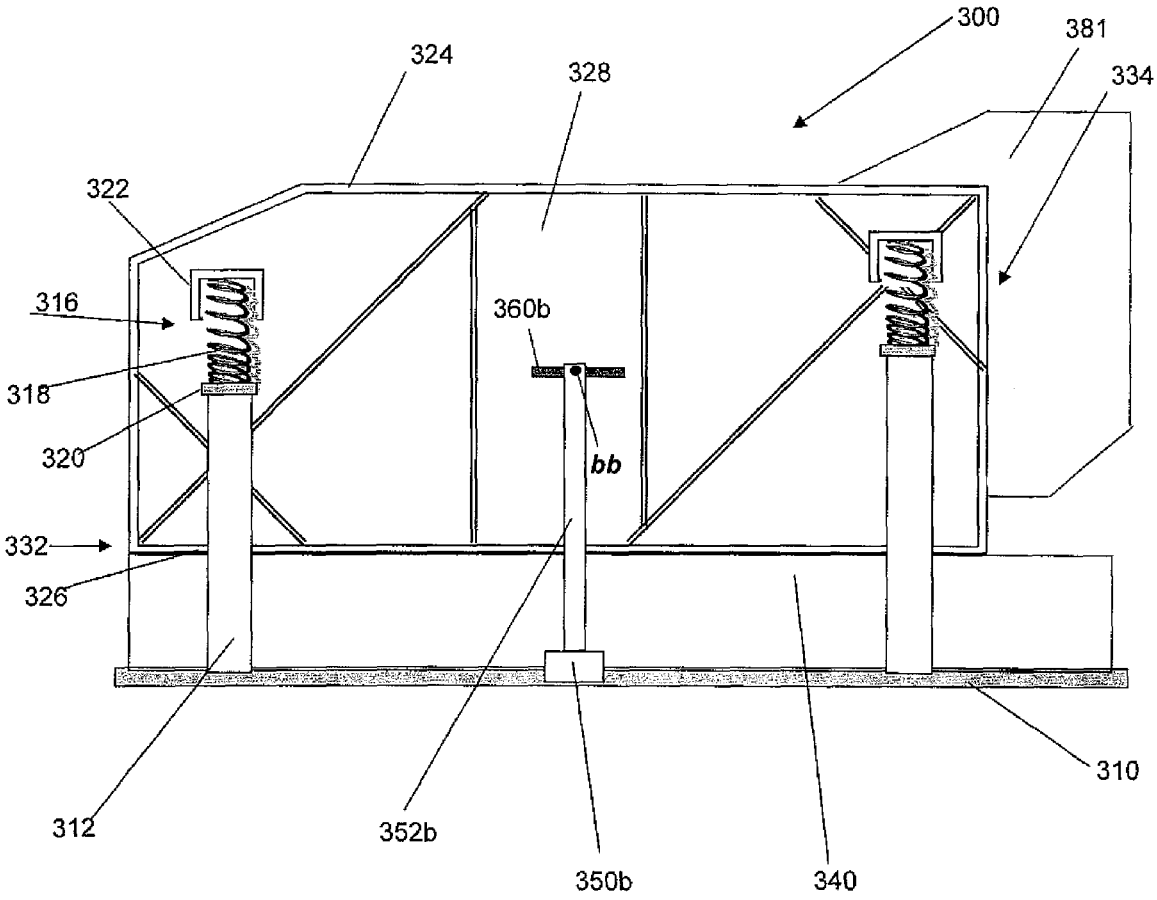

Referring now to FIGS. 3A and 3B, a vibratory separator 300 in accordance with embodiments of the present disclosure are shown. Separator 300 includes a skid 310, with separator 300 mounted thereon. A basket 324 also include a bed frame 326, side walls 328, a discharge end 332, and an inlet end 334. A pan 340 is disposed between basket 324 and skid 310. Pan 340 may be used for collecting drilling fluid separated during the vibratory process.

Vibratory separator 300 includes four legs 312 as necessary for support. Optionally mounted on legs 312 are resilient mounts 316. Each resilient mount 316 includes a spring 318, a resilient mount base 320 on each leg 312, and a socket 322 to receive each spring 318. Positioned on base 310 adjacent the resilient mounts 316 is a basket 324. One of ordinary skill in the art will appreciate that any number of resilient mounts 316 may be used, and the position of resilient mounts 316 may be varied, without departing from the scope of the present disclosure.

In other embodiments, one or more magnetic components may be disposed on one or more side walls 328. For example, as illustrated in FIG. 3A, one or more motors 350*a* are disposed above pan 340 and beneath a possum belly 381. One of ordinary skill in the art will appreciate that basket 324 may not include possum belly 381, and still be within the scope of the present disclosure.

A motor shaft 352*a* is attached to motor 350*a*, and motor shaft 352*a* may extend horizontally proximate one or more side walls 328. As illustrated, a flex shaft 355*a* is attached perpendicular to motor shaft 352*a*, and be configured to rotate along a central axis aa. One of ordinary skilled in the art will appreciate that flex shaft 355*a* may be disposed at any angle depending upon where magnetic components 360*a* are mounted on basket 324.

A magnetic holder (not shown) may be attached around the perimeter of flex shaft 355*a*. The magnetic holder may thereby secure a plurality of first magnetic components 360*a* substantially parallel to flex shaft 355*a*, such that the magnets are arranged radially around flex shaft 355*a*. One of ordinary skill in the art will appreciate that the magnetic holder may be comprised of any material, and may include clasps for holding first magnetic component 360*a*. Further, one of ordinary skill in the art will appreciate that the magnetic holder is not necessary, and first magnetic component 360*a* may be directly mounted on flex shaft 355*a*.

A second magnetic component 361*a* is disposed opposite first magnetic component 360*a* and disposed on one or more side walls 328. Rotation of the flex shaft 355*a* causes first magnetic component 360*a* to rotate. The rotation of first magnetic component 360*a* cyclically alternates between attracting and repulsing second magnetic component 361*a*, thereby imparting vibratory motion to basket 324.

In other embodiments, one or more motors may be attached to skid 310. For example, as illustrated in FIG. 3B, motors 350*b* are disposed on skid 310. A motor shaft 352*b* is attached to motor 350*b*. Motor shaft 352*b* may thereby extend vertically proximate one or more sidewalls 328 of basket 324. A flex shaft (not shown) may be attached perpendicular to motor shaft 352*b*, and be configured to rotate along a central axis bb. One of ordinary skilled in the art will appreciate that the flex shaft (not shown) may be disposed at any angle to motor shaft 352*b* depending upon where the magnetic components are mounted on basket 324.

A magnetic holder (not shown) may be attached to an end of the flex shaft (not shown). The magnetic holder may thereby secure first magnetic component 360*b* substantially perpendicular to the flex shaft (not shown). One of ordinary skill in the art will appreciate that the magnetic holder may be comprised of any material, and may include clasps for holding first magnetic component 360*b*. Further, one of ordinary skill in the art will appreciate that the magnetic holder is not necessary, and first magnetic component 360*b* may be directly mounted on the flex shaft (not shown).

A second magnetic component (not shown) is disposed opposite first magnetic component 360*b* and disposed on one or more side walls 328. Rotation of the flex shaft (not shown) causes first magnetic component 360*b* to rotate in a propeller like motion. The rotation of the first magnetic component 360*b* cyclically alternates between attracting and repulsing second magnetic component (not shown), thereby imparting vibratory motion to basket 324.

In some embodiments, the vibrational frequency of the basket may be adjustable or controllable by the rotational speed of one or more motors. In other embodiments, the vibrational amplitude of the basket may be adjustable or controllable by the rotational speed of one or more motors. As such, the vibrational frequency and the vibrational amplitude may be adjustable, thereby allowing for independent control of both the amplitude and frequency of the vibrational movement. Additionally, where the angle of motion is adjustable, one or more of amplitude, frequency, and direction of movement may be controlled or adjusted. As such, the motion may be controlled to obtain a desired separatory profile.

Additionally, embodiments disclosed herein may provide for controllable and adjustable performance with respect to vibrational force (acceleration), vibrational frequency, and vibrational amplitude.

In some embodiments, the rotational velocity of one or more motors may be increased, thereby increasing the vibratory speed of the vibratory separator. To provide a linear motion to the separator that effectively shears drilling material, a high frequency force may be used. In one embodiment, to provide an appropriate force to shear the drilling material, one or more motors may be connected to a variable frequency drive (VFD).

Vibratory separators in accordance with embodiments of the present disclosure may include one or more VFD's configured to control a rotational speed of one or more motors by controlling a frequency of electrical power supplied to the corresponding motor. The VFD allows the motor to rotate its motor shaft and/or flex shaft at various frequencies. In embodiments having two or more motors, each motor may be connected to an independent VFD, and the magnetic component attached to each motor may rotate at a higher or lower frequency depending on its individual configuration. Imparting a high and a low frequency force in a predetermined pattern may have the benefit of imparting an elliptical, linear, round, or horizontal directional motion depending on the configuration of each motor. However, one of ordinary skill in the art will appreciate that depending on specific design variables of vibratory separators (e.g., motor size) and operational parameters (e.g., drilling material viscosity), the operational speed of the motors may be varied accordingly.

In certain embodiments of the present disclosure, a PLC may be included with the vibratory separator to provide instructions for separatory profiles. The instructions may include separatory profiles to provide, for example, a desired type of motion. The PLC may control the motor, the VFD, or both. Additionally, instructions may be provided to the PLC to allow "on the fly" adjustment of motion types so that an operator may select an appropriate separatory profile. By allowing a range of profiles, an operator may select a type of vibratory motion that provides efficient separating of drill fluid from drill cuttings. Additionally, programming instructions may be provided to allow a PLC to automatically adjust the type of force supplied according to a predetermined vibratory separator condition, such as, for example, a time interval and/or a sensed operating condition. Thus, in one embodiment, a PLC may be included that determines and/or calculates operating conditions of a vibratory separator, and adjusts the separatory profile accordingly. In other embodiments, sensors may be included to determine load, so that the motor may self-adjust accordingly.

In general, for embodiments disclosed herein, the first magnetic component and the second magnetic component include at least one magnet mounted perpendicular to the motor shaft. Additionally, each magnetic component may include one or more magnets arranged in a distinct pattern, such that the first magnetic component and the corresponding second magnetic component are arranged in an identical pattern. However, one of ordinary skill in the art will appreciate that it is not necessary for corresponding magnetic components to be arranged in an identical pattern.

Figure 4A:
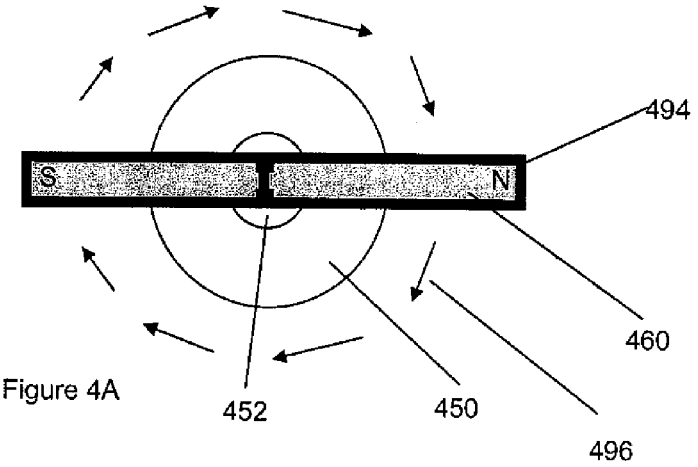
FIGS. 4A-4C are perspective views of magnetic components in accordance with embodiments of the present disclosure.
Figure 4B:
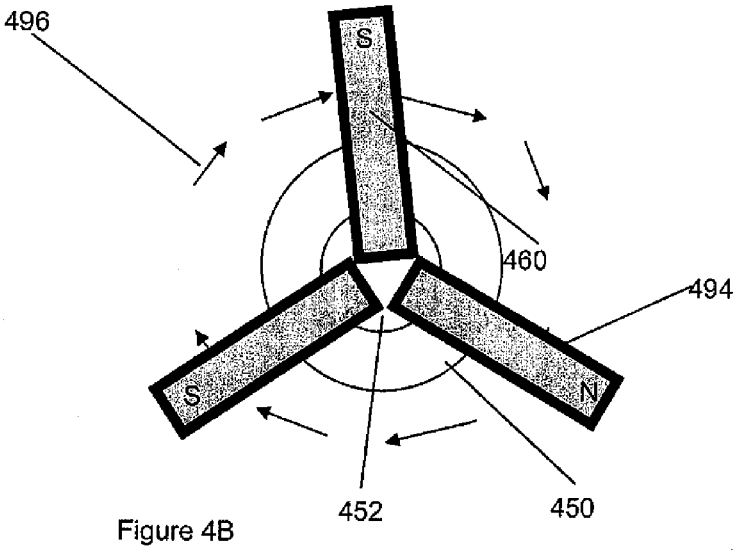
Figure 4C:
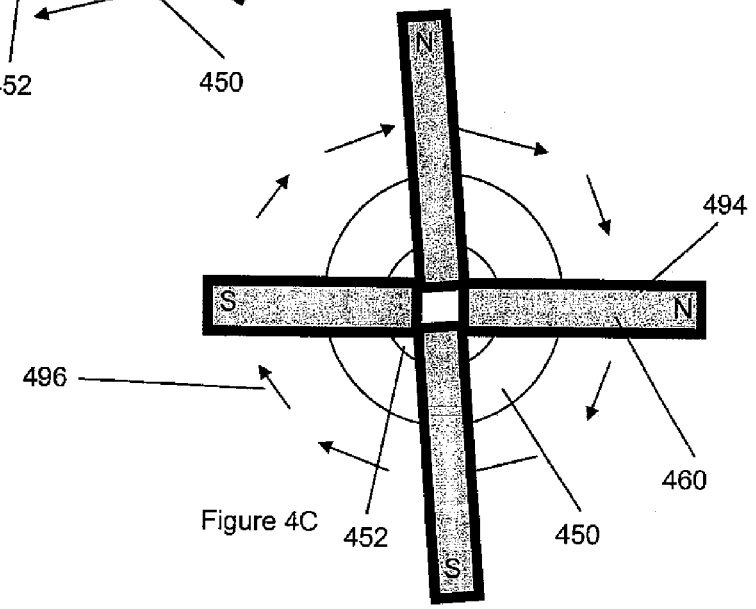

Referring now to FIGS. 4A-4C, a top view of a motor 450 and motor shaft 452 are shown. One or more magnets 460 are secured to a magnetic holder 494. As illustrated, the holder 494 is secured perpendicular to motor shaft 452. One of ordinary skill in the art will appreciate that holder 494 is not necessary, and magnets 460 may be directly mounted to motor shaft 452.

As the motor shaft rotates on its axis, the magnets 460 rotate in a propeller like motion as indicated by arrows 496. One of ordinary skill in the art will appreciate that motor shaft 452 may change direction and rotate in the opposite direction, thereby reversing the direction of arrows 496. Generally, the end of each magnet 460 is designated as a south or north pole. However, in some embodiments the magnets 460 may be disposed such that the polarities are directed in an proximal and distal orientation with respect to the motor shaft 452 and/or magnetic holder 494. As magnets 460 rotate, a second similar arrangement (not shown) of magnets are mounted to basket (not shown) opposite the first arrangement of magnets 460, such that the cyclic motion of magnets 460 alternate between attracting and repulsing different ends of the magnets (not shown) mounted to the basket, thereby imparting a vibratory motion to the basket. The placement of the motors and magnets may dictate the direction of the motion. Furthermore, one of ordinary skill in the art will appreciate that magnets mounted to the basket may be stationary, or designed to move in accordance with magnets 460.

Advantageously, embodiments disclosed herein provide apparatuses and methods for separating drilling fluids and solids more efficiently. The impartation of vibratory motion using magnetic forces may increase the shearing potential to drilling materials, thereby increasing the quality of processed drilling materials. That is, by increasing the shearing potential, dryer solid cuttings may be produced and drilling fluid recovery increased. By increasing drilling fluid recovery, the cost of a drilling operation may decrease. Additionally, by producing drying solid cuttings the likelihood of environmental contamination may be decreased. Moreover, dryer solid cuttings may decrease the cost of cuttings disposal by decreasing the weight and contamination potential, thereby further decreasing the net cost of the drilling operation. Furthermore, the use of magnets to impart vibratory motion may decrease costs associated with parts and replacement parts for the vibratory separator.

While the present disclosure has been described with respect to a limited number of embodiments, those skilled in the art, having benefit of the present disclosure will appreciate that other embodiments may be devised which do not depart from the scope of the disclosure described herein. Accordingly, the scope of the disclosure should be limited only by the claims appended hereto.

What is claimed is:

1. A vibratory separator, comprising:

a base a basket positioned on the base, the basket comprising a first magnetic component disposed thereon;

a screen coupled to the basket;

a motor disposed on the base, the motor comprising a motor shaft and a second magnetic component coupled to the motor shaft;

wherein the first magnetic component and the second magnetic component are disposed proximate each other to magnetically interact; and wherein the motor rotates the second magnetic component to alternate between attracting and repulsing the first magnetic component, thereby vibrating the basket with respect to the base.

2. The vibratory separator of claim 1, wherein the second magnetic component is coupled to the motor shaft by a magnetic holder.

3. The vibratory separator of claim, 1 further comprising a second motor, wherein the first motor supplies a motion to the basket in a direction substantially opposite the direction of the second motor.

4. The vibratory separator of claim 1, wherein the vibratory motion imparted by the motor changes the direction of the vibratory motion imparted to the basket.

5. The vibratory separator of claim 1, further comprising at least one variable frequency drive operatively coupled to the motor.

6. The vibratory separator of claim 1, wherein the motor imparts a directional motion to the basket.

7. The vibratory separator of claim 6, wherein the directional motion is at least one selected from a group of motions consisting of vertical, horizontal, linear, round, and elliptical.

8. The vibratory separator of claim 1, further comprising a programmable logic controller.

9. The vibratory separator of claim 8, wherein the programmable logic controller controls the vibratory motion imparted to the basket by varying at least one selected from a group consisting of displacement distance, displacement frequency, acceleration, and velocity.

10. The vibratory separator of claim 5, further comprising a programmable logic controller operatively coupled to the variable frequency drive.

11. The vibratory separator of claim 1, wherein the motor further comprises a flex shaft.

12. A method of operating a vibratory separator comprising:

injecting drilling material into a vibratory separator, the vibratory separator comprising:

a base;

a basket positioned on the base comprising a first magnetic component disposed on the basket;

a screen coupled to the basket; and a motor disposed on the base, the motor comprising a motor shaft and a second magnetic component coupled to the motor shaft;

wherein the first magnetic component and the second magnetic component are arranged to magnetically interact; and wherein the interaction between the first magnetic component and the second magnetic component imparts a vibratory motion to the basket;

rotating the motor shaft and second magnetic component, via the motor, to alternate between attracting and repulsing the first magnetic component, thereby vibrating the basket with respect to the base; and adjusting a separatory profile in response to a change in a property of the injected drilling material by adjusting the interaction between the first magnetic component and the second magnetic component.

13. The method of claim 12, wherein the motor imparts a directional motion to the basket.

14. The method of claim 13, wherein the directional motion is at least one selected from a group of motions consisting of vertical, horizontal, linear, round, and elliptical.

15. The method of claim 12, further comprising:

a programmable logic controller configured to provide instructions to the motor.

16. The method of claim 15, wherein the instructions comprise a vibratory motion.

17. The method of claim 16, wherein the separatory profile is one selected from a group consisting of a time interval profile and a operation specific profile.

18. The method of claim 12, further comprising:

varying a frequency of the vibratory motion imparted by the motor with a variable frequency drive.

* * * * *